United States Patent [19]

Ohtani et al.

[11] Patent Number: 4,822,709

[45] Date of Patent: Apr. 18, 1989

[54] BINDER-TYPE CARRIER SUITABLE FOR A DEVELOPING METHOD OF ELECTROSTATIC LATENT IMAGES

[75] Inventors: Junji Ohtani, Osaka; Eiichi Sano, Takatsuki; Toshitaro Kohri, Higashiosaka, all of Japan

[73] Assignee: Minolta Camera Kabushiki Kaisha, Osaka, Japan

[21] Appl. No.: 70,934

[22] Filed: Jul. 8, 1987

[30] Foreign Application Priority Data

Jul. 10, 1986 [JP] Japan ..... 61-163146

[51] Int. Cl.[4] ..... G03G 9/10

[52] U.S. Cl. ..... 430/106.6; 430/108

[58] Field of Search ..... 430/108, 106.6

[56] References Cited

U.S. PATENT DOCUMENTS

| | | | |
|---|---|---|---|
| Re. 31,072 | 11/1982 | Jadwin et al. | 430/99 |
| 3,533,835 | 10/1970 | Hagenbach et al. | 430/108 |
| 3,669,885 | 6/1972 | Wright et al. | 252/62.1 |
| 3,720,617 | 3/1973 | Chatterji et al. | 252/62.1 |
| 3,795,618 | 3/1974 | Kasper | 252/62.1 |
| 3,840,464 | 10/1974 | Van Engeland et al. | 252/62.1 |
| 3,873,356 | 3/1975 | Queener et al. | 430/108 |
| 3,898,170 | 8/1975 | Kasper | 252/62.1 |
| 3,916,065 | 10/1975 | Moriconi et al. | 430/108 |
| 4,013,573 | 3/1977 | Leikhim et al. | 252/89 R |
| 4,062,693 | 12/1977 | Berger | 106/308 Q |
| 4,493,855 | 1/1985 | Sachdev et al. | 427/41 |
| 4,517,268 | 5/1985 | Gruber et al. | 430/39 |
| 4,518,673 | 5/1985 | Noguchi et al. | 430/108 |
| 4,555,466 | 11/1985 | Okada | 430/106.6 |
| 4,600,675 | 7/1986 | Iwasa et al. | 430/106.6 |
| 4,609,603 | 9/1986 | Knapp | 430/39 |
| 4,672,016 | 6/1987 | Isoda et al. | 430/108 |

FOREIGN PATENT DOCUMENTS

| | | |
|---|---|---|
| 57-122449 | 8/1982 | Japan . |
| 57-190957 | 9/1982 | Japan . |
| 59-37553 | 3/1984 | Japan . |
| 59-69762 | 4/1984 | Japan . |
| 59-200262 | 11/1984 | Japan . |
| 59-201064 | 11/1984 | Japan . |
| 59-223458 | 12/1984 | Japan . |
| 60-50543 | 3/1985 | Japan . |
| 60-107038 | 6/1985 | Japan . |
| 60-147750 | 8/1985 | Japan . |
| 60-170865 | 9/1985 | Japan . |

OTHER PUBLICATIONS

F. Lions, K. V. Martin, *Journal of the American Chemical Society,* 1957, 79, 2733–2738, 6/5/57.

*Primary Examiner*—John L. Goodrow

*Attorney, Agent, or Firm*—Burns, Doane, Swecker & Mathis

[57] ABSTRACT

The invention relates to binder type carriers comprising at least magnetic particles and binder resin, characterized by that the binder resin has the characteristics of;

(a) melting viscosity at 100° C. ($\eta_{100}$ (poise));

$$4.5 \leqq \log(\eta_{100}) \leqq 8.2$$

(b) temperature dependence of melting viscosity; ($d_\eta/dT$ (poise/°K.));

$$1.2\times10^{-2} \leqq -d(\log\eta)/dT \leqq 9.5\times10^{-2}$$

and (c) softening temperature (Tm) (°C.);

$$95 \leqq Tm < 145.$$

Binder type carriers of the invention have high specific volume resistance of equal or more than $10^{13}\Omega$cm even if magnetic fine particles of more than 500 parts by weight are dispersed in binder resin of 100 parts by weight.

Carriers of the invention can be applied to copying machines with developing sleeves rotating at high speed, the adherence of the carriers to photosensitive members or the development of the carriers do not occur and good images free from deficits are formed.

5 Claims, 1 Drawing Sheet

BINDER-TYPE CARRIER SUITABLE FOR A DEVELOPING METHOD OF ELECTROSTATIC LATENT IMAGES

BACKGROUND OF THE INVENTION

This invention relates to binder-type carriers, more particularly, to binder-type carriers suitable for a developing method of electrostatic latent images, in which developers consisting of toners and magnetic carriers are carried to a developing region by a rotating developing sleeve with a magnet in the inside and the electrostatic latent images on the surface of a photosensitive member are developed in the developing region.

Conventionally, a magnetic brush of magnetic developers contacted with a photosensitive member which functions as a carrier of electrostatic latent images is formed by magnetic forces on the surface of a developing sleeve to develop the electrostatic latent images on the photosensitive member, in which mixtures of magnetic carriers such as iron particles of about 100–200 μm in a mean particle size with insulating toners of about 10–20 μm in a mean particle size were used as developers. The developers lead to problems such as white lines in developed images because an ear of the brush is hard due to a strong attractive force between the carrier particles and the carrier particles aggregate in the form of chains or fins on the surface of the developing sleeve. When the content of toner decreases by continuous use of the developers further problems occur such as the disorder of the electrostatic latent images, the deficit of the developed images and the adherence of the carriers to a part of the electrostatic latent images on the photosensitive member and the like. This occurs because the charge of the electrostatic latent images on the photosensitive member tends to discharge through the low specific resistant carriers of $10^6$ Ω.cm or less. An additional defect is that the hard carriers adhered to the electrostatic latent images on the photosensitive member damage the surface of the photosensitive member when they are cleaned by, for example, a blade cleaner.

On the other hand, in order solve the above problems caused by the carriers consisting only of magnetic materials, the U.S. Pat. No. 4,284,702 made public binder-type carriers of 5–30 μm in a mean particle size, in which magnetic fine materials are dispersed in such an insulating materials as resin, etc. and they have been put in practical use. The above binder-type carriers have an advantage that excellent images free from white lines are formed because of low magnetization of about 1000 gauss in the magnetic field generated in a general developing machine to be able to produce a soft ear. But, the binder-type carriers of this kind increase the cost of a developing machine by requiring a high torque-supplying motor as well as a weak point of heat of a developing sleeve in application thereof to recently required high-speed development.

A generally desired developing machine has a system in which a magnetic brush of a develooper formed by rotating a magnet inside the developing sleeve transports developer on a developing sleeve. But a change of magnetic polarity brought about by a rotating magnet, especially at low speed, results in surface irregularity, which tends to increase as the developing speed, i.e., the movement speed of an electrostatic latent image carrier, increases. It is necessary in order to prevent the above problem that a magnet is made rotate at as high a speed as possible. The rotating speed of the magnet, which is in general set within the range of 1000–2500 r.p.m., should be higher than the moving speed of the electrostatic latent image carrier. Thus, the higher the developing speed, the more the whirling electrical current increases. That results in heat of the developing sleeve to a higher temperature, besides the increment of a rotating driving load and the requirement of a high torque supplying motor. Further, some commercially available electrophotographic reproduction machines employ developing machines which are systematized not only with a high speed rotating magnet but also with an assistantly rotating developing sleeve. However, these machines cannot prevent the above mentioned problems.

A method comprising rotating only a developing sleeve with a magnet fixed (hereinafter referred to as "the developing sleeve rotating system") does not generate the problem caused by a rotating magnet as compared to the magnet rotating method. Accordingly, there may be a proposed attempt to apply binder type carriers for the magnet rotating system to the developing sleeve rotating system in order to solve the defect accompanied by the rotation of a magnet and simultaneously to provide good images free from white lines caused by the aggregation of magnetic materials. But, even if the binder type carriers are merely applied to the developing sleeve rotating system, the obstacle encountered in practical use is that a great number of carriers adhere to a part of the non-image on the surface of an electrostatic latent image carrier and so the above proposed attempt has not been put to practical use.

The higher the ratio of magnetic particles to binder resin in binder type carriers, the lower the electrical resistance of the carriers. Especially in the case of binder type carriers with small particle size, the hygroscopicity becomes higher enhancing the above problem.

SUMMARY OF THE INVENTION

The object of the invention is to solve the above problems in the magnetic carriers used in the developing method of electrostatic latent images on an electrostatic latent image carrier which comprises sending magnetic developers consisting of toners and magnetic carriers by either rotating a developing sleeve with a magnet in the inside or rotating both the magnet and the developing sleeve, and to provide binder type carriers which do not aggregate and can form a soft brush to provide good images free from white lines.

Another object of the invention is to provide carriers with high specific volume resinstance.

Another technical subject of the invention is to provide sharp images given a suitable edge effect and to prevent the adhering of carriers to parts of images on the surface of an electric latent image carrier which is caused by the injection of charges from the developing sleeve.

Another technical subject of the invention is to prevent the charge storage caused by triboelectrification to stabilize the chargeability of toners and to prevent adhering of carriers to parts of non-images on the surface of an electrostatic latent image carrier.

Another technical subject of the invention is to prevent the deterioration of carriers and extend their useful life.

DETAILED DESCRIPTION OF THE INVENTION

Figure 1:
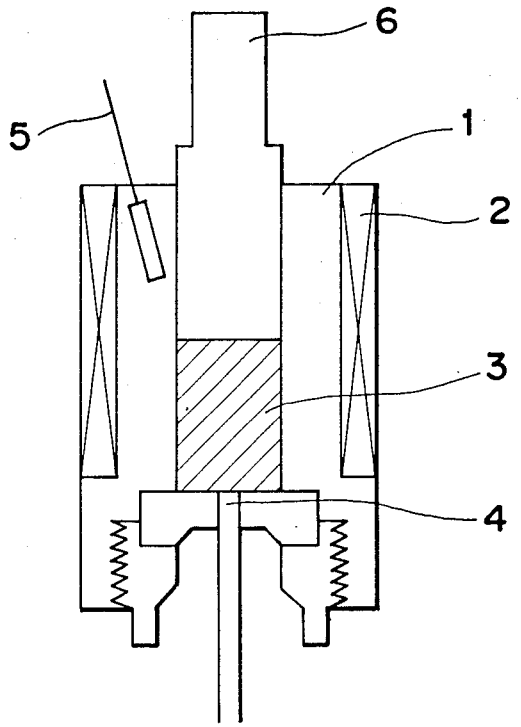
FIG. 1 illustrates a schematic view of a viscosity measuring instrument.

The present invention relates to binder type carriers comprising at least magnetic particles and binder resin, characterized by that the binder resin has the characteristics of;

(a) melting viscosity at 100° C. ($\eta_{100}$ (poise));

$$4.5 \leqq \log(\eta_{100}) \leqq 8.2$$

(b) temperature dependence of melting viscosity; ($d\eta/dT$ (poise/°K.));

$$1.2\times10^{-2} \leqq -d(\log\eta)/dT \leqq 9.5\times10^{-2}$$

and (c) softening temperature (Tm) (°C.);

$$95 \leqq Tm \leqq 145$$

Examples of the binder resin applicable in the invention are: the acrylic resin containing carboxyl group, hydroxyl group, glycidyl group, amino group and the like, for example, a copolymer of a monomer such as methacrylic acid, acrylic acid, maleic acid, itaconic acid, etc. a hydroxyl containing monomer such as hydroxylpolypropylene-monomethacrylate, polyethylene glycol-monomethacrylate, etc., an amino group containing monomer such as dimethylaminoethyl methacrylate, etc., or glycidyl methacrylate and the like with lower alkyl acrylate and/or styrene; polyester resin, for example, a condensate of polyol such as ethylene glycol, triethylene glycol, 1,2-propylene glycol, 1,4-butanediol, etc., with dicarboxylic acid such as maleic acid, itaconic acid, malonic acid, etc.; and thermoplastics such as epoxy resin, etc.; a mixture of the above resin, which may have different characteristics which depend upon resin preparation conditions such as the temperature, the kind of catalyst, the an amount of catalyst, the reactive time, and, the addition of a chain transfer agent or a crosslinking agent.

It is important in the invention that binder type carriers are composed of thermoplastics selected from the above resin with characteristics of;

(a) melting viscosity at 100° C. ($\eta_{100}$ (poise));

$$4.5 \leqq \log(\eta_{100}) \leqq 8.2$$

(b) temperature dependence of melting viscosity; ($d\eta/dT$ (poise/°K.));

$$1.2\times10^{-2} \leqq -d(\log\eta)/dT \leqq 9.5\times10^{-2}$$

and (c) softening temperature (Tm) (°C.);

$$95 \leqq Tm \leqq 145$$

The method of measurement of melting viscosity and softening temperature of the resin of the invention is explained with reference to FIG. 1.

1.5 g of a sample (3) is charged in a cylinder (1) (1 $cm^2$ of the sectional area) with a heater (2) to be heated at the heating rate of 3° C./min. A piston is inserted into the cylinder. The piston (6) is loaded with 30 $kg/cm^2$ of the sample to be flowed through a nozzle (4) (1 mm of the diameter), and then the amount of efflux of the sample, the drop distance of the piston and the temperature are read. The temperature is detected by a temperature sensor (5).

In the embodiment of the above measurement, the dropping type flow tester CFT-500 (made by Shimazu Ltd.) is applicable.

The softening temperature of resin is read as the temperature detected when the piston is dropped down by 4.8 mm.

The amount of efflux is measured at different temperatures by the above method and the viscosity at each temperature is calculated according to the expression below;

$$\text{viscosity} = \pi R^4.P/8.L.Q \text{ (poise)}$$

wherein

R: the radius of the nozzle (0.5 mm);

P: the load (30 $kg/cm^2 \rightarrow 3.059\times10^{-4}$ Pa);

L: the length of the nozzle (0.1 cm);

Q: the rate of efflux (ml/sec);

$$Q: 1.5.S/t$$

wherein

S: the cross-sectional area of the cylinder (1 $cm^2$)

t: necessary time for piston to drop down by 1.5 cm

The temperature dependence of the melting viscosity $d(\log\eta)/dT$ is obtained as the gradient of the straight line of $\log\eta$ to T calculated by the method of least squares.

The melting viscosity, the temperature gradient of the melting viscosity and the softening temperature are defined as measured above in the invention.

We found that the characteristics of binder type carriers in the invention, especially, specific volume resistance, have various values in relation to the kind of resin used. The application of this fact made it possible to prepare carriers with high specific resistance.

In general, magnetic particles employed in magnetic carriers are low-resistant materials of about $10^6$ Ω.cm. In preparing binder type carriers composed of the above magnetic particles, it is preferred for the magnetic particles to be not only binded but also covered with resin. But that is very difficult for binder-type carriers which need to contain a greater amount of magnetic particles than that of resin. Therefore, the surface of low electrical resistant materials is exposed out of the carrier particles. Accordingly, the specific volume resistance of binder resin is influenced by volume conduction in addition to surface conduction. From that viewpoint, in preparing binder type carriers by mixing binder resin with magnetic particles, it is preferred that all possible surface of the magnetic particles be covered with resin with as small a melting viscosity as possible. It has been, although, found not necessarily preferred that the melting viscosity is as small as possible. On the other hand, magnetic particles employed in binder type carriers, especially magnetic particles with small particle size, aggregate to form secondary particles. The secondary particles are powdered to form as many first particles as possible and mixed with resin to be dispersed, so the resin needs "stickness" to some degree. That is, unless magnetic particles are supplied with shearing force caused by resin, magnetic particles cannot be powdered and dispersed in the resin.

From the above, the relationship of viscosity of resin, softening temperature, etc., with specific volume resistance of binder type carriers composed of the resin is examined and it has been found that the binder type carriers have high specific volume resistance if composed of the thermoplastics with the characteristics of;

(a) Melting viscosity at 100° C. ($\eta_{100}$ (poise));

$$4.5 \leqq \log(\eta_{100}) \leqq 8.2$$

(b) temperature dependence of melting viscosity; ($d\eta/dT$ (poise/°K.);

$$1.2\times10^{-2} \leqq -d(\log\eta)/dT \leqq 9.5\times10^{-2}$$

and (c) softening temperature (Tm) (°C.);

$$95 \leqq Tm \leqq 145$$

The binder type carriers composed of the resin with the above characteristics show $11^{11}$–$10^{16}$ Ω.cm of the specific volume resistance. $10^{12}$–$10^{16}$ Ω.cm is preferred in practical use.

From the above viewpoint, more preferred is the resin with the characteristics of;

$$5.5 \leqq \log(\eta_{100}) \leqq 6.5$$

$$2.5\times10^{-2} \leqq -d(\log\eta)/dt \leqq 7.5\times10^{-2}$$

$$100 \leqq Tm \leqq 130$$

The object of the invention is achieved by employing a resin which satisfies the values of $\eta_{100}$, $-d(\log\eta)/dt$ and Tm.

The Tm may also be expressed by the glass transition temperature (Tg(°C.)), and the invention is also achieved by employing the resin with $40 \leqq Tg \leqq 80$, preferably $45 \leqq Tg \leqq 70$.

The magnetic carriers of the invention are prepared by dispersing magnetic particles in insulating binder resin and any magnetic materials with $10^7$ Ω.cm or more of specific volume resistance may be used as magnetic particles. Particularly, ferrite is suitable.

Concrete examples of ferrite, which are shown in U.S. Pat. No. 4473438, have the general formula;

$$M_{\frac{1-x}{1+x}(1-y)}Fe_{\frac{2x}{1+x}(1-y)}O_y$$

wherein M is an atom selected from the group consisting of Ni, Co, Mg, Cu, Zn and Cd; x is within the range of between 0.5 and 1.0 and y is within the range of between 0.1 and 0.571.

Ferrite suitable for use in the invention, in addition to the ferrite described above, includes metals containing ferromagnetic metals such as magnetite shown by $FeO.Fe_2O_3$, iron, nickel and cobalt, etc., alloys of the metals and compounds thereof.

The magnetic fine particles are generally mixed with binder resin at the ratio of 200–900 parts by weight to 100 parts by weight of the binder resin.

Sufficient magnetization cannot be achieved in the beforementioned magnetic field if the magnetic fine particles are less than 200 parts by weight, and carriers are fragile if the magnetic fine particles are more than 900 parts by weight.

The preferred carriers of the invention from the magnetic viewpoint have $1000 \leqq Bm \leqq 7000$, preferably $2000 \leqq Bm \leqq 3000$ as magnetic flux density of the carriers (Bm) (gauss). An ear of a magnetic brush gets too hard if magnetic flux density is more than 7000 gauss and enough magnetization cannot be achieved in the magnetic field if magnetic flux density is less than 1000 gauss.

It is an advantage of the invention that specific volume resistance of carriers can be kept high, that is, equal or more than $10^{13}$ Ω.cm even if magnetic fine particles of more than 500 parts by weight are dispersed in binder resin. This advantage has not previously been achieved because carriers resulted in too low a specific volume resistance to have practical use.

In general, carriers containing about 200–about 900 parts by weight on the basis of 100 parts by weight of binder resin must be particularly treated to make the electrical resistance high before they are put to use, for it is considered to be true in all resin that only the low electrical resistance carriers can be prepared because the inadequate dispersion of magnetic particles and the dispersion of an insufficient amount of powdered magnetic particles results in a low electrical resistance or because high hygroscopicity results in increasing the surface conductivity.

It can be hardly recognized that the high electrical resistant carriers not previously achievable can be prepared by the selection of resin, the selection of reactive conditions or the selection of resin with specified physical properties according to the invention.

Carriers of the invention can be applied to copying machines furnished with high rotation developing sleeves to protect the adherence of the carriers to photosensitive members and carrier development to images and give good images free from deficits.

If specific volume resistance of carriers is decreased, such as to $10^8$–$10^{12}$ Ω.cm, the specific volume resistance of developers also decreases. In such case, the latter resistance can be made higher by increasing the content of the toner in the developer, generally 5 wt.% or more, but this manner is not preferred, because it does not give a suitable edge-effect and many carriers are inevitably adhered to images by injected charges when the content of toner in the developer decreases as the developing progresses.

The carriers of the invention are prepared as follows; binder resin with magnetic particles are mixed sufficiently at the specified mixing ratio, heated and followed by being ground and classified after cooling.

In a preferred embodiment of the invention, in order to prevent the aggregation of carriers and the adherence thereof to an electrostatic latent image carrier more perfectly, the mean particle size of the carriers is adjusted to the range of between 15–100 μm in weight average particle size. The carriers tend to aggregate and adhere to the electrostatic latent image carrier resulting in the deterioration of the carrier flowability, if the mean particle size of the carriers is less than 15 μm. Brushing surface irregularity and the like occur as can be similarly seen in iron particle carriers and clean images cannot be formed, if the mean particle size of the carriers is more than 100 μm. Further, the carriers of the invention may be given;

(a) the surface treatment by fine particles such as silica, titanium oxide, aluminum oxide, etc.

(b) the heat treatment in order to modify the surface of the carriers after usual grinding, classifying and size-arranging of the particles.

This invention will now be explained with reference to examples hereunder.

EXAMPLE

| Synthesis of resin: | parts by weight |
|---|---|
| styrene | 70 |
| butyl methacrylate | 30 |
| methacrylic acid | 4 |
| azobisisobutyronitrile | 3.4 |

The mixture of the above composition was dissolved in xylene of 200 parts by weight followed to be prepolymerized in the nitrogen current at 100° C. for 20 minutes. Thereafter, the reactive conditions such as (a) temperature, (b) an amount of a catalyst (c) reactive time, (d) a kind of a chain transfer agent and the like were varied to prepare resin $\alpha-\epsilon$ with different physical properties.

Glass transition temperature (Tg), softening temperature (Tm), melting viscosity at 100° C. ($\eta_{100}$), temperature gradient of melting viscosity (d(log $\eta$)/dT) are shown in Table 1.

TABLE 1

| resin | $\alpha$ | $\beta$ | $\gamma$ | $\delta$ | $\epsilon$ |
|---|---|---|---|---|---|
| Tg (°C.) | 57 | 62 | 63 | 65 | 66 |
| Tm (°C.) | 90 | 162 | 113 | 133 | 152 |
| log ($\eta_{100}$) | 3.7 | 5.3 | 6.1 | 7.4 | 8.2 |
| d (log$\eta$)/dT | $-0.82\times10^{-2}$ | $-1.0\times10^{-2}$ | $-6.8\times10^{-2}$ | $-8.3\times10^{-2}$ | $-10.8\times10^{-2}$ |

Then, the above resin $\alpha\sim\epsilon$ were blended to prepare resin A–L.

The blending ratio of resin $\alpha\sim\epsilon\times$Tg, $\eta_{100}$, and d(log $\eta$)/dT of the resulting resin A–L are shown in Table 2.

TABLE 2

| resin | $\alpha$ | $\beta$ | $\gamma$ | $\delta$ | $\epsilon$ | log ($\eta_{100}$) | d(log$\eta$)/dT | Tm(°C.) |
|---|---|---|---|---|---|---|---|---|
| A | | 15 | 85 | | | 6.0 | $6.1\times10^{-2}$ | 108 |
| B | 20 | 80 | | | | 4.8 | $1.2\times10^{-2}$ | 99 |
| C | 80 | 20 | | | | *4.0 | *$0.9\times10^{-2}$ | *93 |
| D | | | | 25 | 75 | 8.0 | $9.4\times10^{-2}$ | 145 |
| E | | | | 15 | 85 | *8.3 | *$10.2\times10^{-2}$ | *147 |
| F | | 10 | 90 | | | 6.2 | $6.5\times10^{-2}$ | 111 |
| G | | | 50 | 50 | | 6.7 | $7.6\times10^{-2}$ | 121 |
| H | 70 | 15 | 15 | | | *4.3 | *$1.1\times10^{-2}$ | *82 |
| I | | | | 17 | 83 | *8.3 | *$9.6\times10^{-2}$ | *146 |
| J | 50 | 50 | | | | *4.2 | $1.2\times10^{-2}$ | 98 |
| K | | | | 20 | 80 | 8.0 | *$9.8\times10^{-2}$ | 143 |
| L | | | 5 | 5 | 90 | 8.1 | *$10.5\times10^{-2}$ | *148 |

*out of the range of the claim of the invention

| Preparation of carriers: | parts by weight |
|---|---|
| resin A | 100 |
| magnetic particle (EPT-1000, produced by Toda Kogyo Co.) | 500 |
| carbon black (MA #8, produced by Mitsubishi Kasei Co.) | 2 |

The above materials were sufficiently ground, mixed by a henschel mixer and then fused to be kneaded by the extrusion kneader with the cylinder and the cylinder head settled at 200° C., and 190° C. respectively. The kneaded materials were ground finely by the jet mill and then classified by the classifier to prepare magnetic carriers with 55 $\mu$m in mean particle size.

The resulting carriers had the specific volume resistance of $1.2\times10^{14}$ $\Omega$.cm.

| Preparation of Toners: | Parts by weight |
|---|---|
| (i) (−) chargeable toners | |
| polyester resin (130° C. of softening temperature; 60° C. of glass transition temperature) | 100 |
| carbon black (MA #8 produced by Mitsubishi Kasei Co.) | 5 |
| (ii) (+) chargeable toners | |
| styrene-n-butyl methacrylate resin (132° C. of softening temperature; 60° C. of glass transition temperature) | 100 |
| Carbon black (MA #8 produced by Mitubisi kasei Co.) | 5 |
| nigrosine dye (Bontron N-01 produced by Orient Chemical Co.) | 3 |

The above materials were mixed sufficiently with ball mills and kneaded on three rolls heated at 140° C. The kneaded materials were cooled, ground roughly with the feather mill, ground finely with the jet mill, and then air-classified to obtain fine particles of 13 $\mu$m in mean particle size. The respective polar toners are hereinafter referred to as toner A ((−) chargeable toners) and toner B ((+) chargeable toners).

Preparation of Developers

Toner A or toner B was mixed with the carriers at the ratio of 10 wt% for 10minutes to prepare developers.

Evaluation

[specific volume resistance of carriers]

The specific volume resistance of carriers of the resulting carriers was measured.

The specific volume resistance was measured as shown below.

A sample of 1 mm in thickness and 50 mm in diameter was put on a round electrode made of metal and then an electrode of 895.4 g in weight and 20 mm in diameter and a guarded electrode of 38 mm in internal diameter and 42 mm in external diameter are put on the sample to be supplied with 500 V of direct voltage. The value of resistance was read after 1 minute to calculate the specific volume resistance of the sample. The environment of the measurement was 25±1° C. of temperature and 55±5% of relative humidity and the measurement was repeated five times to obtain the mean value.

[Evaluation of chargeability, images and copying resistance]

The charge amount of toner measured after preparation of developers was −11.5 $\mu$C/g.

The developers prepared with the toner A were put to use to develop positively charged electrostatic charge images according to the magnetic brush developing method with the developing machine equipped with a (+) chargeable Se-type photosensitive member and a heat-fixing roll coated with teflon (registered trade mark). The development was continuously repeated 60000 times. The copied images were good and had no carrier fogs appeared even after the copying resistant test of 60000 times as well as at the initial stage of the test. No carriers were seen adhered to the photosensitive member.

Toner B was tested similarly. The charge amount of toner measured after it was mixed for 10 minutes was +12.7 μC/g and copied images were free from fogs of carriers and excellent even after the copying resistant test of 60,000 times as well as at the initial stage of the test. But in this case of toner B, the system for the test of copying resistance was the same as that in the case of toner A except that a (−) chargeable laminated-type organic photosensitive member was applied and negatively-charged electrostatic charge images were developed and transferred.

The above results were shown in Table 3.

Example 2–5

Resin B, D, F and G were put to use to prepare carriers, and to prepare developers containing toner A or toner B and the developers were examined on the charge amount and the copying resistance in a similar way as Example 1. The results were shown in Table 3.

TABLE 3

| Example | Resin | specific volume resistance (Ω · cm) | charge amount of toner | initial stage of carrier resistant test: carrier fogs | initial stage of carrier resistant test: image quality | after 60000 times of copying resistant test: carrier fogs | after 60000 times of copying resistant test: image quality |
|---|---|---|---|---|---|---|---|
| | | | (use of toner A) (−μC/g) | | | | |
| 1 | A | $1.2 \times 10^{14}$ | 11.5 | none | good | none | good |
| 2 | B | $2.6 \times 10^{15}$ | 11.8 | none | good | none | good |
| 3 | D | $4.7 \times 10^{14}$ | 12.2 | none | good | none | good |
| 4 | F | $3.1 \times 10^{15}$ | 11.4 | none | good | none | good |
| 5 | G | $1.1 \times 10^{15}$ | 11.8 | none | good | none | good |
| | | | (use of toner B) (+μC/g) | | | | |
| 1 | A | $1.2 \times 10^{14}$ | 12.7 | none | good | none | good |
| 2 | B | $2.6 \times 10^{15}$ | 13.3 | none | good | none | good |
| 3 | D | $4.7 \times 10^{14}$ | 13.2 | none | good | none | good |
| 4 | F | $3.1 \times 10^{15}$ | 12.9 | none | good | none | good |
| 5 | G | $1.1 \times 10^{15}$ | 13.0 | none | good | none | good |

Comparative Example 1

Resin C was put to use to prepare carriers in a similar way as Example 1. The specific volume resistance of the carriers was $9.7 \times 10^9$ Ω.cm. The charge amount of toner A was −8.5 μC/g after the developer containing 10 wt% of toner A was mixed for 10 minutes. The developer was put to use to test for copying resistance with a similar copying machine for (−) toners as Example 1. The copied images were good and had a only few fogs at the initial stage of the test, but after 1000 times of development, the concentration of images was low and many carrier fogs can be seen in copied papers.

The same phenomenon was observed on toner B. The charge amount of toner B was +7.8 μC/g.

Comparative Examples 2–7

Resin E, H, I, J, K and L were put to use to prepare carriers, and to prepare developers containing toner A or toner B. The developers were examined on the charge amount and the copying resistance in a similar way as Example 1. The results were shown in Table 4. Some carriers provide an equal charge amount as that in Example 1, but carrier fogs were hardly prevented in all cases.

TABLE 4

| Comparative Example | Resin | specific volume resistance (Ω · cm) | charge amount of toner | initial stage of carrier resistant test: carrier fogs | initial stage of carrier resistant test: image quality | after 60000 times of copying resistant test: carrier fogs | after 60000 times of copying resistant test: image quality |
|---|---|---|---|---|---|---|---|
| | | | (use of toner A) (−μC/g) | | | | |
| 1 | C | $9.7 \times 10^9$ | 8.5 | a few | good | many | bad |
| 2 | E | $1.4 \times 10^{10}$ | 8.8 | many | bad | many | bad |
| 3 | H | $1.7 \times 10^{10}$ | 10.5 | a few | good | many | bad |
| 4 | I | $1.2 \times 10^{10}$ | 8.6 | many | bad | many | bad |
| 5 | J | $5.1 \times 10^{10}$ | 10.9 | a few | good | many | bad |
| 6 | K | $8.3 \times 10^9$ | 11.1 | " | " | many | bad |
| 7 | L | $1.4 \times 10^{10}$ | 11.3 | " | " | many | bad |
| | | | (use of toner B) (+μC/g) | | | | |
| 1 | C | $9.7 \times 10^9$ | 7.8 | a few | good | many | bad |
| 2 | E | $1.4 \times 10^{10}$ | 8.2 | many | bad | many | bad |
| 3 | H | $1.7 \times 10^{10}$ | 7.9 | many | bad | many | bad |
| 4 | I | $1.2 \times 10^{10}$ | 12.1 | a few | good | many | bad |
| 5 | J | $5.1 \times 10^{10}$ | 13.0 | a few | good | many | bad |
| 6 | K | $8.3 \times 10^9$ | 12.3 | a few | good | many | bad |
| 7 | L | $1.4 \times 10^{10}$ | 11.6 | a few | good | many | bad |

All developers provided clear and fogs-free images and showed good chargeability.

Example 6

The reactor equipped with a stirrer was charged with 700 parts by weight of polyoxypropylene (2.2)-2,2-bis(4-hydroxyphenyl) propane and 97.2 parts by weight of terephthalic acid, set in a mantle heater, converted to the nitrogen atmosphere, and heated up, and then dibutyltin oxide of 0.05 g was added to the contents to begin the reaction. Further, 15.6 g of anhydrous 1,2,4-carboxy-benzene was added to the above contents to give resin which had the characteristics of 120° C. of softening temperature, $-6.72\times10^{-2}$ of $d\eta/dT$ and 5.94 of log ($\eta_{100}$).

The resulting resin was put to use to prepare carriers at the same composition ratio as Example 1. The specific volume resistance of the resulting carriers was $9.94\times10^{14}$ Ω. cm. Toner A was mixed with the carriers at the ratio of 10 wt.% to prepare developers. The charge amount of the toner showed $-11.7$ μC/g after the developer was mixed for 10 minutes.

The developer was put to use to develop positively-charged electrostatic charge images according to the magnetic brush developing method with the developing machine equipped with a (+) chargeable Se-type photosensitive member and a heat-fixing roll coated with teflon. The development was continuously repeated 60,000 times. The images were excellent and had no carrier fogs after the copying resistant test of 60,000 times as well as at the initial stage of the test. No carriers were seen adhered to the photosensitive member. Toner B was examined similarly. The charge amount was $+13.5$ μC/g after the developer was mixed for 10 minutes and the copied images were free from fogs of carriers and excellent even after the copying resistant test of 60,000 times as well as at the initial stage of the test. But, in this case of toner B, the system for the test of copying resistance was the same as that in the case of toner A except that a (−) chargeable laminated-type organic photosensitive member was applied and negatively-charged electrostatic charge images were developed and transferred.

What is claimed is:

1. A binder type carrier comprising magnetic particles and binder resin, characterized in that the binder resin has the characteristics of:

(a) a melting viscosity at 100° C. ($\eta_{100}$) (poise)) of:

$$4.5\leqq\log(\eta_{100})\leqq8.2$$

(b) a temperature dependence of the melting viscosity of: ($d_\eta/dT$ (poise/°K.));

$$1.2\times10^{-2}\leqq-d(\log\eta)/dT\leqq9.5\times10^{-2}$$

and (c) a softening temperature (Tm) (°C.) of:

$$95\leqq Tm\leqq145.$$

2. The binder type carrier according to claim 1 wherein the melting viscosity is:

$$5.5\leqq\log(\eta_{100})\leqq6.5.$$

3. The binder type carrier according to claim 1 wherein the temperature dependence of the melting viscosity is:

$$2.5\times10^{-2}\leqq-d(\log\eta)/dT\leqq7.5\times10^{-2}.$$

4. The binder type carrier according to claim 1 wherein softening temperature (Tm) (°C.) is:

$$100\leqq Tm\leqq130.$$

5. The binder type carrier according to claim 1 comprising 200–900 parts by weight of magnetic particles calculated on the basis of 100 parts by weight of binder resin.

* * * * *